US009992826B1

(12) United States Patent
Safaee

(10) Patent No.: US 9,992,826 B1
(45) Date of Patent: Jun. 5, 2018

(54) DUAL MODE CONSTANT CURRENT LED DRIVER

(71) Applicant: Alireza Safaee, Bedford, MA (US)

(72) Inventor: Alireza Safaee, Bedford, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days. days.

(21) Appl. No.: 15/608,275

(22) Filed: May 30, 2017

(51) Int. Cl.
*H05B 37/02* (2006.01)
*H05B 33/08* (2006.01)

(52) U.S. Cl.
CPC ..... *H05B 33/0809* (2013.01); *H05B 33/083* (2013.01); *H05B 33/0815* (2013.01); *H05B 33/0887* (2013.01)

(58) Field of Classification Search
CPC ..... H05B 33/0848; H05B 33/0815; H05B 33/0824; H05B 37/02
See application file for complete search history.

(56) References Cited

U.S. PATENT DOCUMENTS

| | | | | |
|---|---|---|---|---|
| 9,584,022 | B1 * | 2/2017 | Galvano | H02M 3/158 |
| 2011/0101933 | A1 * | 5/2011 | Lopata | H02M 3/1588 323/271 |
| 2014/0009981 | A1 * | 1/2014 | Charles Knill | H02M 7/48 363/37 |
| 2016/0308445 | A1 * | 10/2016 | King | H02M 1/44 |
| 2017/0033689 | A1 * | 2/2017 | Chen | H02M 3/1582 |
| 2017/0094736 | A1 * | 3/2017 | Xiong | H05B 33/0815 |
| 2017/0339761 | A1 * | 11/2017 | Pan | H05B 33/0815 |
| 2018/0031157 | A1 * | 2/2018 | Copeland | F16L 21/022 |

* cited by examiner

*Primary Examiner* — Tung X Le
*Assistant Examiner* — Raymond R Chai
(74) *Attorney, Agent, or Firm* — Yutian Ling

(57) ABSTRACT

A dual mode constant output current LED driver is capable of operating with a very wide range of input direct current (DC) voltage. This provides an effective topology for a wide range of constant output current LED drivers, and allows for changing the number of connected LEDs without negatively impacting the output current. The LED driver includes a converter and a mode selection circuit that control the modes of the circuit based on the voltage. The converter and mode selection circuit operate in a buck-boost mode when the output voltage of the LED driver is less than the DC input voltage plus a first threshold amount, and in a boost mode when the output voltage of the LED driver is greater than the DC input voltage plus a second threshold amount.

19 Claims, 6 Drawing Sheets

DUAL MODE CONSTANT CURRENT LED DRIVER

FIELD OF THE DISCLOSURE

The present disclosure relates to power supplies suitable for driving light emitting diode (LED) lighting systems as well as other electronic loads.

BACKGROUND

Strings of light emitting diodes (LEDs), such as those used in advanced automotive headlights, also referred to as "matrix" headlights, use an LED driver to control the brightness of the headlight. Pulse Width Modulation (PWM) dimming is often used to control the brightness of the LED string. Each LED in the LED string is configured to be controlled individually in order to control the overall brightness of the headlight. To implement PWM dimming in an LED driver, a boost stage is generally used to boost the voltage, resulting in a two-stage system.

A typical LED driver 100 that uses PWM dimming for each individual LED is shown in FIG. 1. The LEDs (D112, D114, . . . D118, D120) are connected in series as an LED string 110. Although four LEDs are illustrated in FIG. 1, any number of LEDs can be provided in the LED string 110. There is a bypass switch (S112, S114, . . . S118, S120) in parallel with each LED (respectively, D112, D114, . . . D118 ,and D120) under control of a controller 130. The LED driver is powered by a DC voltage source 140 in conjunction with a DC current source 150. If a switch is open (e.g., S112), the voltage across the corresponding LED (e.g., D112) is greater than a threshold voltage, and thus the current flows through the LED and it emits light. On the other hand, when the switch is closed, the voltage across the corresponding LED is less than the threshold so the LED is turned off. By selecting the relative duration of on and off times, the average brightness of each LED can be individually controlled, which sometimes is referred to as PWM dimming

DETAILED DESCRIPTION

Figure 1:
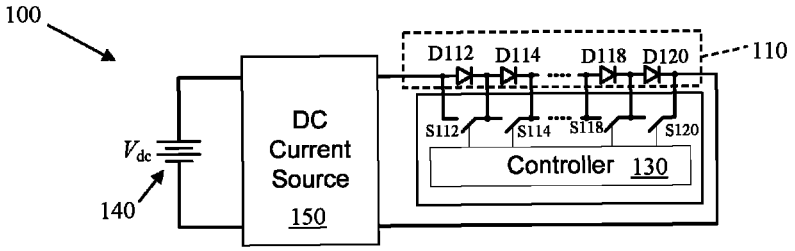
FIG. 1 illustrates a block diagram of an LED driver system having a direct current (DC) current source which provides for dimming of each LED in an LED string.

A dual mode constant output current power supply or so-called driver is disclosed. The driver is capable of operating with a very wide range of input direct current (DC) voltage, and is particularly well-suited for powering switchable LED strings, but can also be used with other switchable load types as will be appreciated in light of this disclosure. The mode of operation is adaptively selected to maximize the efficiency of the converter based on the output voltage conditions of the driver. By selecting the optimum mode in all output voltage conditions, the driver operates efficiently at high frequencies (e.g., greater than approximately 100 kHz) and provides high power density in a compact design. The techniques can be used to provide an effective topology for a wide range of constant output current drivers, and allow for changing the number of connected LEDs (or otherwise changing the switchable load) without negatively impacting the output current, according to some embodiments.

General Overview

Implementing a constant current driver system using PWM involves a number of non-trivial issues, particularly in a switchable LED string application. For example, a typical LED driver architecture for automotive headlight systems includes two stages of conversion, a boost converter stage followed by one or more buck converters. The current source is implemented using a feedback and controller of the buck stage. Therefore the dynamic behavior of the buck stage determines how fast the LED can be switched by the matrix manager unit. When one more LED is turned on, the current drops until the controller reacts and pushes the current up again. And when an LED is turned off (the corresponding switch being turned on) the current suddenly goes up until the feedback reduces it back to the desired level. These control dynamics have an impact on the quality of the light (over- and undershoots in light output) of all the LEDs, not only the one being switched. For the buck converter to act as a current source feeding a string of LEDs (e.g., N switchable LEDs connected in series where N=12 or some other suitable number), there is a need to have a prior boost stage, particularly in applications with potentially relatively low input voltages. The boost stage ensures that the buck input voltage is beyond the total voltage of LEDs. Buck and boost converters are very well established and there are many low-cost controllers and components available for them. In any case, such typical circuits are hard switching topologies which limit the high frequency operation and high power density designs. The voltage stress across the switches can be large which requires switches with higher voltage ratings and therefore higher cost and conduction losses. Also, using feedback to generate a current source behavior has several practical limitations. Moreover, a typical automotive application the battery voltage available for headlights can vary greatly, for example for a nominal 12V battery system, the headlights operates with no derating for the DC voltages from 8 to 24 volts and with derating down to 6 or up to 28 volts. There is a need for LED based automotive headlights with many individually-dimmable LEDs fed by compact and reliable derivers.

The LED driver of the present disclosure includes a converter topology, and a mode selection circuit that control the mode of the circuit based on the voltage to maximize efficiency of the LED driver. The converter topology and mode selection circuit operate in a first buck-boost mode when the output voltage of the LED driver is less than the voltage of the DC power source plus a first threshold amount. The converter topology and mode selection circuit operate in a second boost mode when the output voltage of the LED driver is greater than the voltage of the DC power source plus a second threshold amount. The operation of the converter topology and mode selection circuit is controlled by a controller operatively connected to a switch of the mode selection circuit.

The mode selection circuit according to an embodiment of the present disclosure includes the switch and a diode. The diode is for returning load current to the DC power source on a first path, and the switch is for returning load current to the DC power source on a second path different form the first path. Other circuitry that can selectively pass current along a given path can be used as well, as will be appreciated in light of this disclosure. The converter topology and mode selection circuit operate in a first buck-boost mode when the output of the LED driver is less than the voltage of the DC power source plus a first threshold amount (such as $V_{dc}$+1V), in which the driver controller turns off the switch of the mode selection circuit. The converter topology and mode selection circuit operate in a second boost mode when the output voltage of the LED driver is greater than the voltage of the DC power source plus a second threshold amount (such as $V_{dc}$+5V), where the driver controller turns on the switch of the mode selection circuit.

Circuit Architecture

Figure 2:
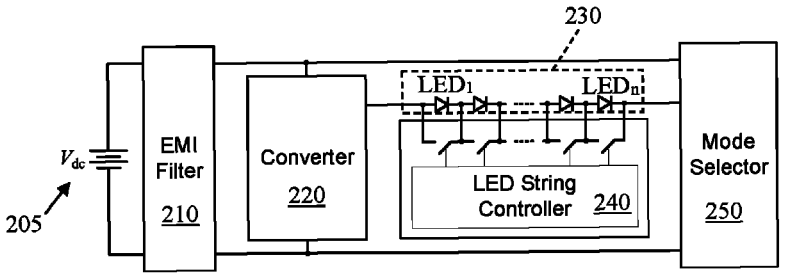
FIG. 2 illustrates a block diagram of an LED driver system configured in accordance with an embodiment of the present disclosure, including a converter topology and a mode selection circuit.

FIG. 2 illustrates a block diagram of an LED driver system including a converter block 220 and a mode selector circuit 250, configured in accordance with an example embodiment of the present disclosure. An electromagnetic interference (EMI) filter 210 is provided between the converter block 220 and a DC voltage source 205. The converter block 220 and mode selector block 250 provide a dual mode constant current LED driver for an LED string 230. The LED string 230 includes a plurality of LEDS, including LED1 up to any number, LEDn, and is also representative of any switchable load that can be driven by the driver system according to an embodiment of the present disclosure. Each LED is switchable and is connected in parallel to a corresponding switch that is under control of the LED string controller 240. Note that a given string may include any number of LEDs, as denoted by LEDn, where n is the total number of LEDs in the string.

The EMI filter 210 eliminates the high frequency current components from the DC power source 205, which can cause interference with other electrical systems, particularly in a vehicle or other complex system with several electrical components and interconnections. In some embodiments, the EMI filter 210 may not be needed, depending on the EMI sensitivity of the given application. Any suitable EMI circuitry can be used here, whether it be custom or proprietary, as will be appreciated.

The converter block 220 provides the current to the LED string 230. The current source nature of the converter block 220 ensures adequate light generation in each LED regardless of the number of actives LEDs in the string. Also the mode selector block 250 selects the mode of operation by selecting the node to which the LED string current is directed, depending upon the output voltage of the LED driver. Further details of the converter block 220 and mode selector block 250 will be discussed in turn with reference to FIGS. 3 through 12C, according to some example embodiments.

Figure 3:
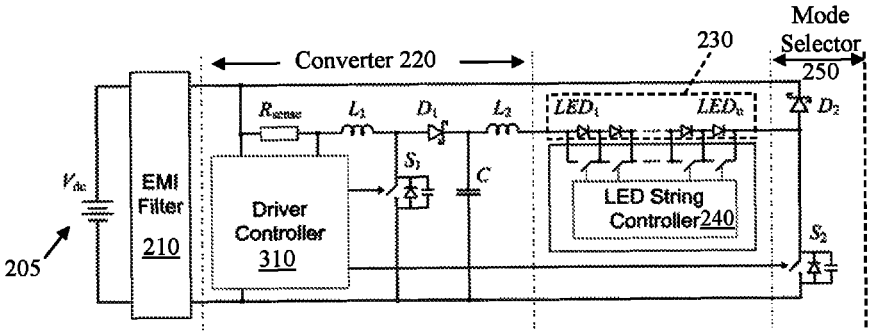
FIG. 3 illustrates an example schematic diagram of the block diagram of FIG. 2, configured in accordance with an embodiment of the present disclosure.

FIG. 3 illustrates an example detailed schematic diagram of the block diagram of FIG. 2, configured in accordance with an embodiment of the present disclosure. The converter block 220 and the mode selector block 250 are shown in an example detailed schematic diagram. The converter block 220 includes a resistor $R_{sense}$, an inductor $L_1$, a switch $S_1$, a diode $D_1$, a capacitor $C_1$ and a second inductor $L_2$. Three components $L_1$, $S_1$, and $D_1$ are the main elements of the converter topology, controlled by the driver controller 310 and $C_1$ is the output capacitor. Capacitor $C_1$ passes the ripple current of $D_1$ to ground. In some embodiments, instead of being connected to ground, capacitor $C_1$ can also be placed between the cathode of $D_1$ and the positive DC line to provide similar functionality. Resistor $R_{sense}$ is the current sensing element used by diver controller 310 to monitor the current flowing through $L_1$ ($i_{L_1}$). Inductor $L_2$ acts as the interface between the low impedance capacitor $C_1$ and the LED string 230 with variable (switchable) number of LEDs. The current source behavior of the converter is ensured by the driver controller 310 which also controls operation of the switch $S_2$ in the mode selector block 250.

Figure 5:
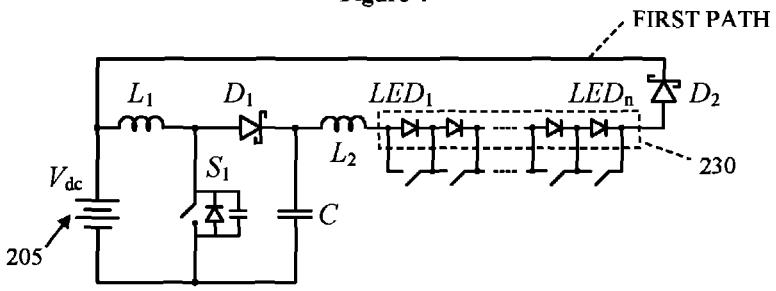
FIG. 5 illustrates a schematic diagram showing the LED driver system when the output voltage of the LED driver is less than a first threshold voltage, operating in buck-boost mode, in accordance with an embodiment of the present disclosure.
Figure 6:
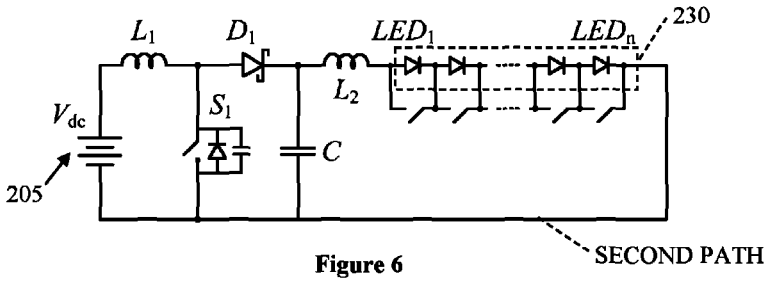
FIG. 6 illustrates a schematic diagram showing the LED driver system when the output voltage of the LED driver is greater than a second threshold voltage, operating in boost mode, in accordance with an embodiment of the present disclosure.

The mode selector block 250 of this example embodiment includes diode $D_2$ and switch $S_2$ under the control of the driver controller 310. The driver controller 310 knows the LED string current, which is equal to the average of $i_{D_1}$ (also equal to average of $i_{L_1}$) when $S_1$ is off. The driver controller 310 also knows the LED string voltage ($V_{LED_String}$) indirectly by knowing the duty cycle of $S_1$, therefore there is no need to have a voltage sensing input. When the output voltage of the LED driver is less than the voltage of the DC power source plus a first threshold voltage (such as $V_{dc}$+1V), the switch $S_2$ is turned off. Refer to FIG. 5 for an example schematic diagram of the driver operating in the buck-boost mode when the switch $S_2$ is turned off. When the output voltage of the LED driver is greater than the DC power source plus a second threshold voltage (for example $V_{dc}$+5V), the switch $S_2$ is turned on, and the LED driver operates in boost mode. Refer to FIG. 6 for an example schematic diagram of the driver operating in the boost mode when the switch $S_2$ is turned on. Note that the output voltage of the LED driver is equivalent to the voltage across the LED string, but does not require this measurement. Rather, the driver controller 310 derives this value and adjusts the operation of the LED driver accordingly. Also, further note that the first threshold voltage of 1V and the second threshold voltage of 5V are only exemplary and it should be appreciated that the threshold voltage amounts can vary from one embodiment to the next. As will be further appreciated in light of this disclosure, the arrangement of components in FIG. 3 is only exemplary and can be varied to achieve the dual modality as shown and described herein. Additional modes can be added, and the present disclosure need not be limited to two-mode configurations, as will be appreciated in light of this disclosure.

Figure 4:
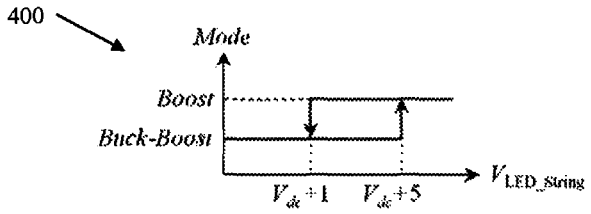
FIG. 4 illustrates a graphical diagram of example waveforms for mode selection according to an embodiment of the mode selection circuit.

FIG. 4 depicts the mode selection diagram of the LED driver, according to an embodiment of the present disclosure. As shown in this example case, the dual mode constant current LED driver operates in a first buck-boost mode when the output voltage of the LED driver is less than the voltage of the DC power source plus a first threshold voltage, in this case 1V (i.e., when the condition $V_{LED\text{-}driver}<V_{dc}+1V$ is met), in which 1V is a first threshold for changing the mode of operation, and is only one example threshold value. Continuing with the example case shown in FIG. 4, the dual mode constant current LED driver operates in a second boost mode when the output voltage of the LED driver is greater than the voltage of the DC power source plus a second threshold voltage, in this case 5V (i.e., when the condition of $V_{LED\text{-}driver}>V_{dc}+5V$ is met), in which 5V is a second threshold for changing the mode of operation, and is only one example threshold value. In accordance with an embodiment, the second threshold voltage is generally greater than the first threshold voltage to enable the first buck-boost mode as the output voltage of the driver becomes less than the DC voltage signal plus the first threshold voltage, and to enable the second boost mode as the output voltage of the driver becomes greater than the DC voltage signal plus the second threshold voltage. In some embodiments, for example, the second threshold voltage is at least 1.0 volts greater than the first threshold voltage, or at least 1.5 volts greater, or at least 2.0 volts greater, or at least 2.5 volts greater, or at least 3.0 volts greater, or at least 3.5 volts greater, or at least 4.0 volts greater, or at least 4.5 volts greater, or at least 5.0 volts greater, or at least 5.5 volts greater, or at least 6.0 volts greater. In a more general sense, and as will be appreciated in light of this disclosure, the delta voltage between the first and second voltage thresholds can be set based on factors such as the overall output voltage range the driver is expected to accommodate. So, for a relatively small output voltage range, the delta voltage between the first and second voltage thresholds may be in the sub-volt range (e.g., the second threshold voltage is at least 0.4 volts greater than the first threshold voltage, or 0.5 volts greater, etc). Note that the value of $V_{LED_String}$, the voltage across the LED string, is equal to the output voltage of the LED driver ($V_{LED\text{-}driver}$), which is derived by the driver controller from $V_{dc}$, $i_{L_1}$, switching frequency and duty ratio of switch $S_1$, all of which are already known by the driver controller 310.

FIG. 5 illustrates a schematic diagram showing the example LED driver system of FIG. 3 when the output voltage of the LED driver is less than a first threshold voltage, operating in buck-boost mode, according to an embodiment. When the number of active LEDs in the LED string 230 is such that the output voltage of the LED driver is less than ($V_{dc}$+1V), the driver controller 310 turns off the switch $S_2$, and therefore the converter block 220 operates in buck-boost mode as shown in FIG. 5. Note that 1V is an example threshold voltage, and may be different in other embodiments (e.g., 0.5V, or 1.5v or 2V, etc.). The switch $S_2$ of the mode selection circuit is turned off (i.e. the switch is open) and the load current is thus returned to the DC power source 205 via a first path, as shown in FIG. 5.

FIG. 6 illustrates a schematic diagram showing the example LED driver system of FIG. 3 when the output voltage of the LED driver is greater than a second threshold voltage, and the LED driver is operating in boost mode, according to an embodiment. Similarly, if the number of active LEDs in the string is such that the output voltage of the LED driver is greater than the DC power source plus 5V, the driver controller 310 turns on the switch $S_2$ and the converter block 220 works in boost mode as depicted in FIG. 6. Diode $D_2$ is reversed biased with the voltage equal to the input DC voltage and there is no extra voltage across it. Note that 5V is an example second threshold voltage for triggering boost mode of operation, and the exact threshold amount of voltage may vary from one embodiment to the next depending upon the particular application for the LED driver (e.g., second threshold voltage may be, for instance, 2.0V, or 2.5V, or 3.0V, or 3.5V, or 4.0V, or 4.5V, or 5.5V, or 6.0V, etc.). In some embodiments, the first and second voltage thresholds are user-configurable. The switch $S_2$ of the mode selection circuit is turned on (i.e. the switch is closed) for returning load current to the DC power source 205 via a second path, as shown in FIG. 6.

Although the standard buck-boost topology has the capability of step-up operation, the current passing through the converter switch is larger than the similar quantity in a boost topology. Therefore a driver configured in accordance with some embodiments of the present disclosure improves performance by operating in boost mode when the output voltage of the LED driver exceeds the DC power source plus a second threshold amount, such as 5V. Both the conduction loss and switching loss are lower in boost mode due to lower switch current and voltage, respectively, and thus the overall efficiency is improved.

Note that there is no need to measure the output voltage directly for mode changing. The LED string voltage can be derived from $V_{dc}$, $i_{L_1}$, the switching frequency and duty ratio of switch $S_1$, all of which are already known by the driver controller 310. This reduces the cost due to lower component count, as there is no need to have voltage measurement components. Further, reliability is improved by not depending on a measurement (across the LED string itself) which can be inexact because of noise or drifting due to thermal effects or the like.

Figure 7A:
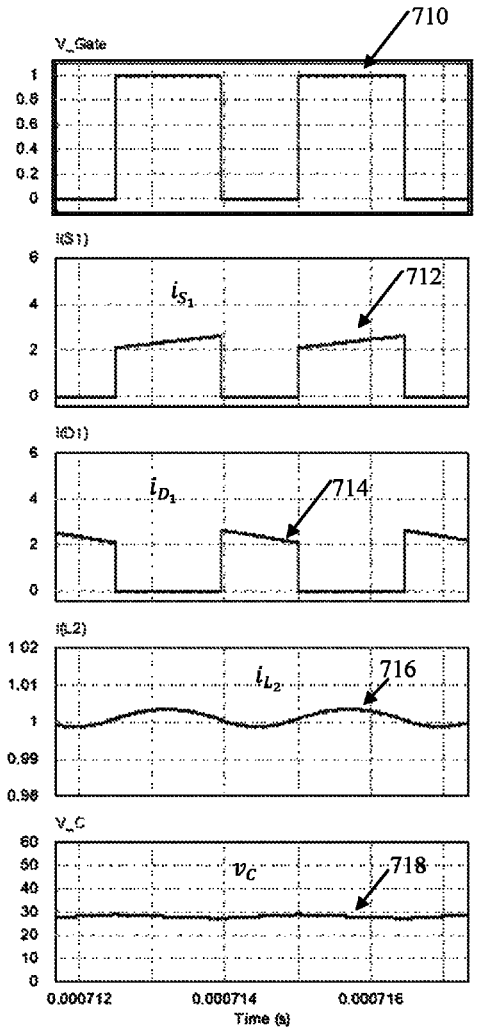
FIG. 7A illustrates a graphical diagram of example waveforms for a DC power source of 12 volts and four LEDs illuminated.

FIG. 7A illustrates a graphical diagram of example waveforms for a DC power source of 12 volts and four LEDs illuminated, operating in a buck-boost mode. Waveform 710 shows the gate voltage (V_Gate), waveform 712 shows the current of the Switch $S_1$, waveform 714 shows the current of the diode D1, waveform 716 shows the current of the second inductor L2 ($i_{L2}$) which is also equivalent to the LED current, and waveform 718 shows the voltage of the capacitor C.

Figure 7B:
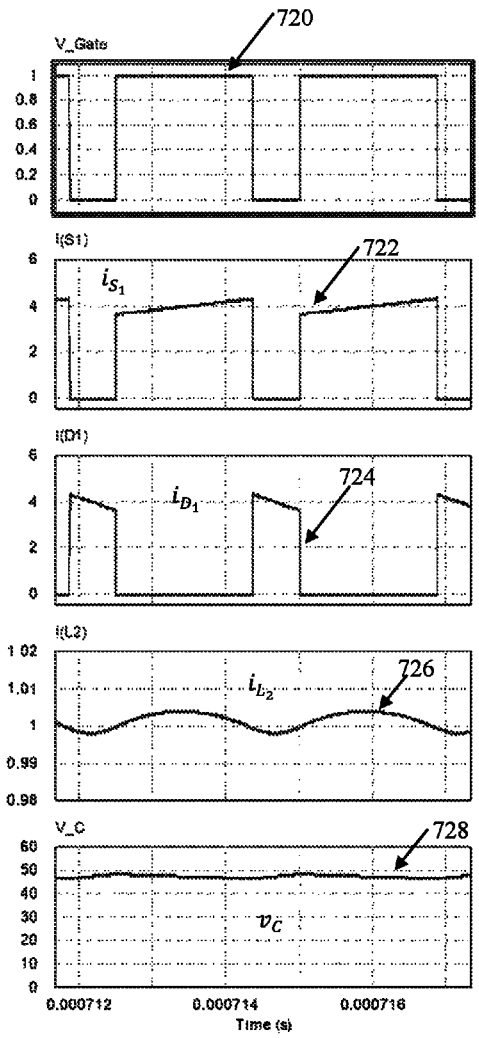
FIG. 7B illustrates a graphical diagram of example waveforms for a DC power source of 12 volts and twelve LEDs illuminated.

FIG. 7B illustrates a graphical diagram of example waveforms for a DC power source of 12 volts and twelve LEDs illuminated. Waveform 720 shows the gate voltage (V_Gate), waveform 722 shows the current of switch $S_1$, waveform 724 shows the current of the diode D1, waveform 726 shows the current of the second inductor L2 ($i_{L2}$) which is equivalent to the LED current, and waveform 728 shows the voltage of the capacitor C.

In the example embodiment of FIGS. 7A and 7B, the output current is adjusted to be one ampere (constant, within some acceptable tolerance). Note that the peak-peak ripple in the LED current ($i_{L2}$) is quite low.

Figure 8:
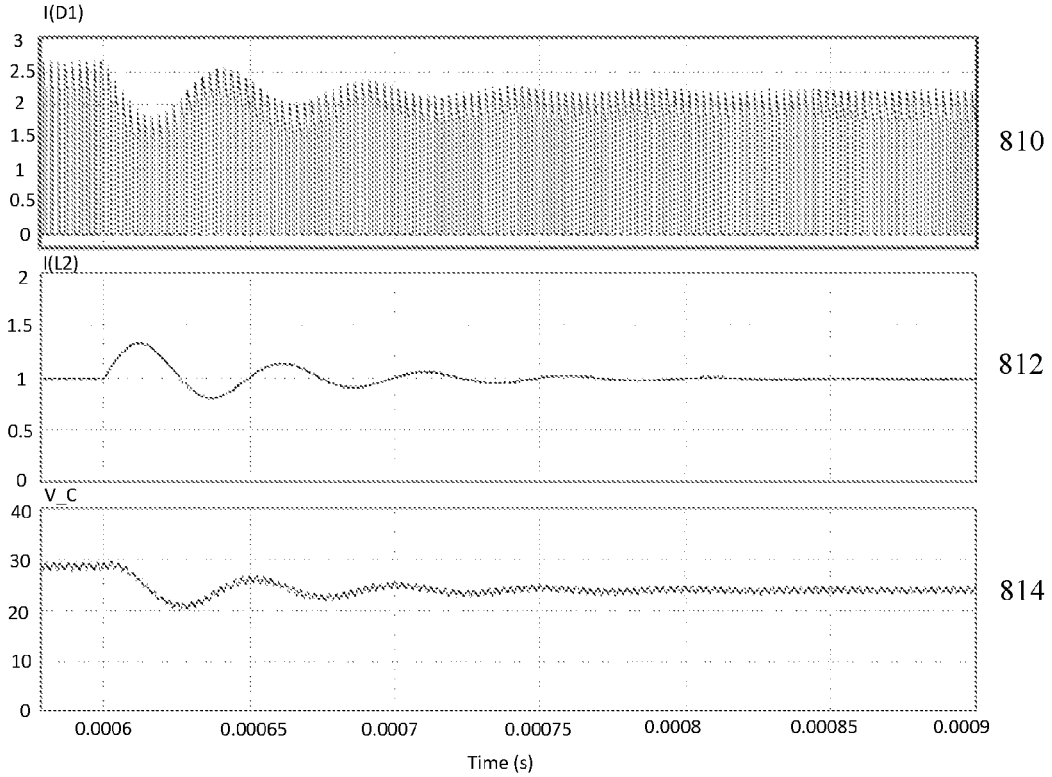
FIG. 8 illustrates a graphical diagram of example waveforms for a DC power source of 12 volts, transitioning from six to four LEDs.

FIG. 8 illustrates a graphical diagram of example waveforms for a DC power source of 12 volts, transitioning from six to four LEDs, for $i_{D_1}$, $i_{L_2}$ and $v_c$ all defined in FIG. 3, according to an embodiment. Waveform 810 shows the transition from six to four LEDs for $i_{D_1}$, waveform 812 shows the transition from six to four LEDs for $i_{L_2}$, and waveform 814 shows the transition from six to four LEDs for $v_c$.

Figure 9:
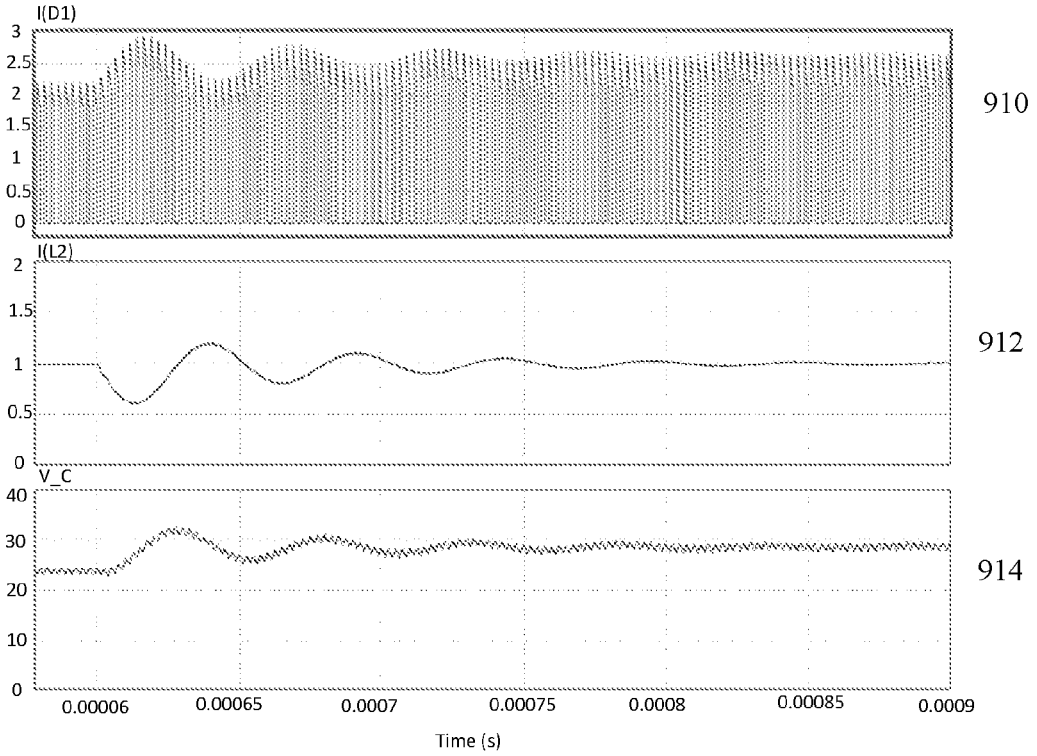
FIG. 9 illustrates a graphical diagram of example waveforms for a DC power source of 12 volts, transitioning from four to six LEDs.

FIG. 9 illustrates a graphical diagram of example waveforms for a DC power source of 12 volts, transitioning from four to six LEDs, for $i_{D_1}$, $i_{L_2}$ and $v_c$ all defined in FIG. 3, according to an embodiment. Waveform 910 shows the transition from four to six LEDs for $i_{D_1}$, waveform 912 shows the transition from four to six LEDs for $i_{L_2}$, and waveform 914 shows the transition from four to six LEDs for $v_c$.

In both example cases shown in FIGS. 8 and 9, note that the LED current $i_{L_2}$, settles down to its nominal value of 1 A.

Figure 10:
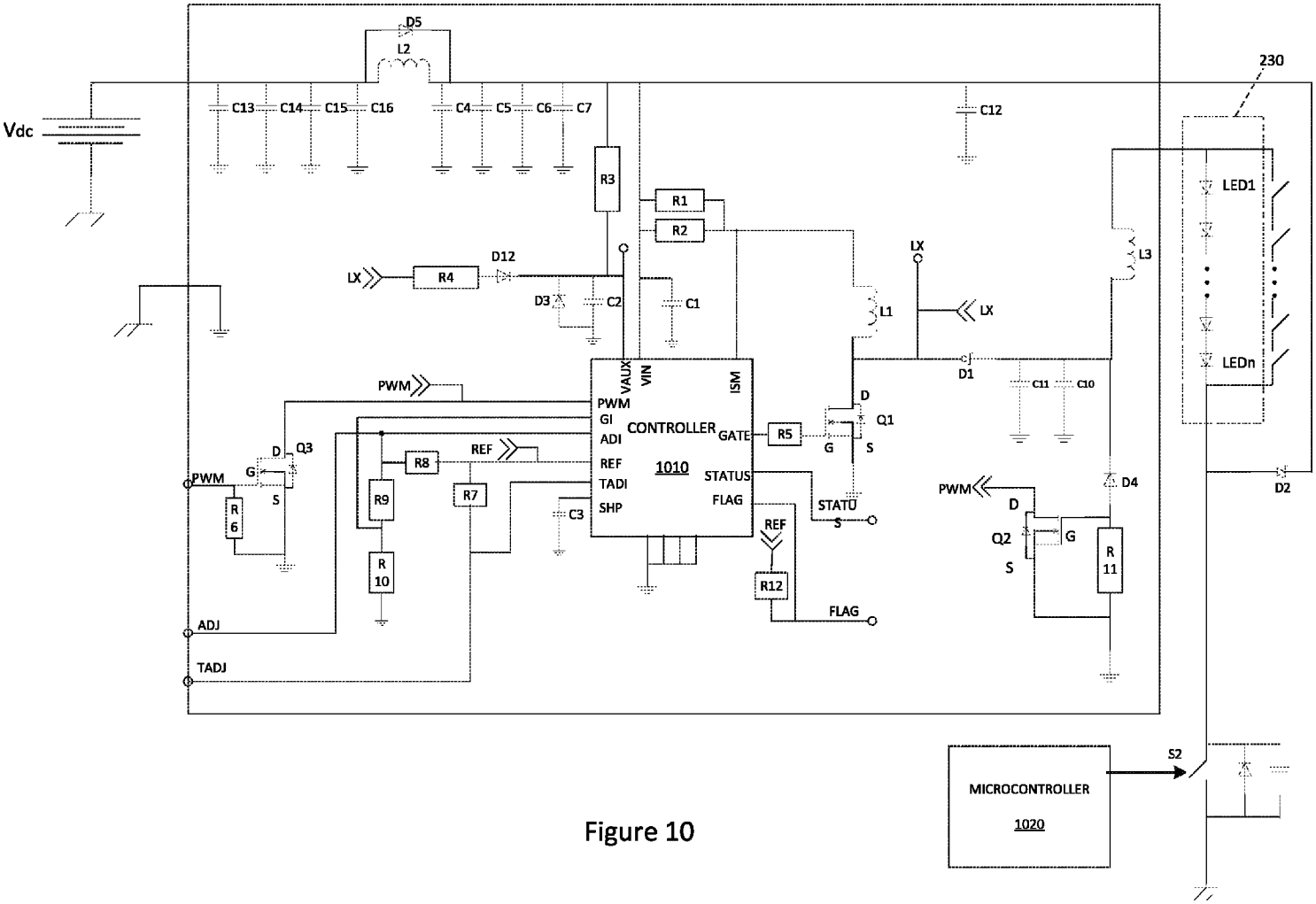
FIG. 10 illustrates a schematic diagram of an example implementation of the LED driver system, in accordance with an embodiment of the present disclosure.

FIG. 10 illustrates a schematic diagram of an example LED driver system, configured according to another embodiment of the present disclosure. As can be seen, the switch $S_2$ is controlled by microcontroller 1020 and can be, for instance, a power MOSFET switch, one example of which is part number IRFP4110 commercially available from INTERNATIONAL RECTIFIER® although any suitable switching circuit can be used. The diode $D_2$ can be any suitable diode, for example part number SB5100 commercially available from FAIRCHILD SEMICONDUCTOR® although any suitable diode circuit can be used. Each of the LEDs can be 1 A, 3V with nominal voltage of 3.5V. The controller 1010 can be a buck/boost/buck-boost LED driver controller, one example of which is part number ZXLD1371, commercially available from ZETEX® although other controllers of comparable or otherwise desired functionality can be used. The LED current can be set at 680 mA according to an example embodiment. The microcontroller 1020 is operatively connected to the switch $S_2$ to control the mode of operation. Note that the microcontroller 1020 can be integrated with the driver controller 1010 in some embodiments, or can be a separate and dedicated microcontroller 1020 that is specifically designed to control operation of the switch $S_2$ in still other embodiments. The example schematic diagram in FIG. 10 is one example implementation. Other arrangements are possible to provide the dual mode constant current LED driver.

Figure 11A:
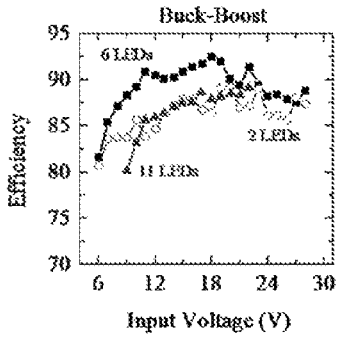
FIG. 11A illustrates a graphical diagram of example results of operating the LED driver system of FIG. 10 in buck-boost mode, showing the efficiency as a function of input voltage.
Figure 11B:
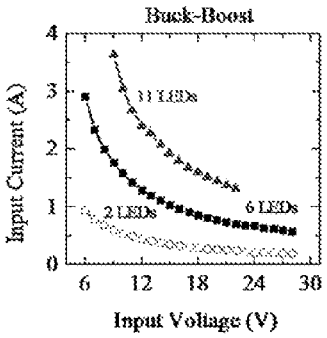
FIG. 11B illustrates a graphical diagram of example results of operating the LED driver system of FIG. 10 in buck-boost mode, showing the input current as a function of input voltage.
Figure 11C:
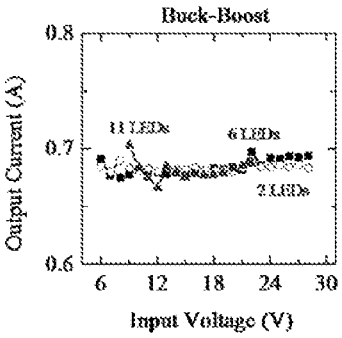
FIG. 11C illustrates a graphical diagram of example results of operating the LED driver system of FIG. 10 in buck-boost mode, showing the output current as a function of input voltage.

FIG. 11A illustrates a graphical diagram of example results of operating the LED driver system of FIG. 10 in buck-boost mode, showing the efficiency as a function of input voltage. FIG. 11B illustrates a graphical diagram of example results of operating the LED driver system of FIG. 10 in buck-boost mode, showing the input current as a function of input voltage. FIG. 11C illustrates a graphical diagram of example results of operating the LED driver system of FIG. 10 in buck-boost mode, showing the output current as a function of input voltage.

Figure 12A:
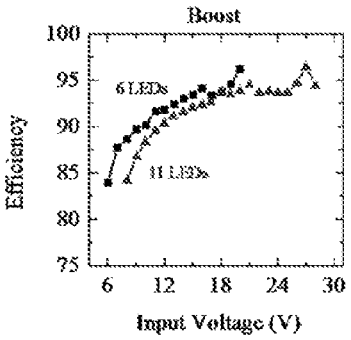
FIG. 12A illustrates a graphical diagram of example results of operating the LED driver system of FIG. 10 in boost mode, showing the efficiency as a function of input voltage.
Figure 12B:
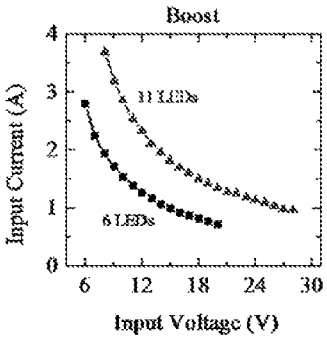
FIG. 12B illustrates a graphical diagram of example results of operating the LED driver system of FIG. 10 in boost mode, showing the input current as a function of input voltage.
Figure 12C:
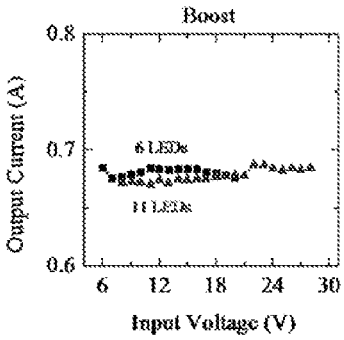
FIG. 12C illustrates a graphical diagram of example results of operating the LED driver system of FIG. 10 in boost mode, showing the output current as a function of input voltage.

FIG. 11A illustrates the efficiency, FIG. 11B illustrates the input currents, and FIG. 12C illustrates the output currents for LED string including 2, 6 and 11 LEDs. The LED string including two LEDs is denoted with a continuous-circle line, the LED string including six LEDs is denoted with a continuous-square line, and the LED string including eleven LEDs is denoted by a continuous-triangle line. For the case of eleven LEDs it was not possible to test input voltages above 19.5 V due to output over voltage protection settings. Regardless of this specific case, FIG. 11C shows that the converter in Buck-Boost mode is capable of operating and keeping the output current regulated, according to an embodiment of the present disclosure.

FIG. 12A illustrates a graphical diagram of example results of operating the LED driver system of FIG. 10 in boost mode, showing the efficiency as a function of input voltage. FIG. 12B illustrates a graphical diagram of example results of operating the LED driver system of FIG. 10 in boost mode, showing the input current as a function of input voltage. FIG. 12C illustrates a graphical diagram of example results of operating the LED driver system of FIG. 10 in boost mode, showing the output current as a function of input voltage.

The case of two LEDs is not compatible with boost mode because in boost mode the output voltage is higher than the input voltage. Also for the cases of six and eleven LEDs the boost mode is applicable up to the input voltage that is smaller than LED string voltage, as evident from the input current graph in FIG. 12B which does not extend beyond 19 V for six LEDs. The threshold is not reached in the case of eleven LEDs. In all the comparable tests (i.e. similar input voltage and number of LEDs), the efficiency is higher in the boost mode, for example as shown in FIG. 12A. In comparing the efficiency of buck-boost mode in FIG. 11A (which ranges from approximately 80 to 90% efficiency), to the efficiency in FIG. 12A, it can be seen that the efficiency in boost mode is significantly improved, approaching 90-95%, and even higher, efficiency. This confirms an advantage of a driver system configured in accordance with an embodiment of the present disclosure compared with a standard buck-boost converter.

Advantages of systems according to some embodiments of the present disclosure should be apparent in light of this disclosure. For instance, possible advantages of some embodiments include single stage of conversion; wide DC input and output voltage ranges; adaptive selection between two modes of operation: buck-boost mode and boost mode; topological capability of step-down operation (in buck-boost mode); topological capability of step-up operation (in both boost and buck-boost modes); voltage boosting functionality (no extra boost stage needed); small size and low-cost passive components; lower component count compared to a two stage solution; only one switch with high switching operation; low harmonic content in the currents and small EMI filter components; wide range of off-the-shelf options for the switches; reduced current in step-up operation by adaptively changing the mode; and higher reliability due to reduced total number of components. Note that not all embodiments of the present disclosure require any or all of these various advantages, and numerous configurations and variations will be apparent in light of this disclosure.

Note that "constant current" as used herein is not intended to imply a literal constant current; rather, reference to constant current is intended to be a current that varies within a given tolerance that is relatively small or otherwise acceptable for a given application, such as a +/− 10% variation, or a +/−5% variation, or a +/−2% variation, or a +/−1% variation, or a +/−0.5% variation. Further note that the tolerance may be asymmetric in some cases. In a more general sense, the tolerance of the constant current may vary from one embodiment to the next, depending on the given application.

Numerous variations and configurations will be apparent in light of the disclosure. For example, one example embodiment of the present disclosure provides a light emitting diode (LED) driver that includes a converter, a mode selection circuit and a controller. The converter may be configured to receive a direct current (DC) voltage signal from a DC power source and convert the DC voltage signal into a constant current source to provide to a load. The mode selection circuit may include a diode for returning load current to the DC power source on a first path, and a first switch for returning the load current to the DC power source on a second path different from the first path. In response to an output voltage of the LED driver being less than the DC voltage signal plus a first threshold voltage, the controller may be configured to turn off the first switch thereby enabling a first mode in which the load current is returned to the DC power source on the first path. In response to the output voltage of the LED driver being greater than the DC voltage signal plus a second threshold voltage, the controller may be configured turn on the first switch thereby enabling a second mode in which the load current is returned to the DC power source on the second path, in which the second threshold voltage is greater than the first threshold voltage.

In some cases, the first mode may be a buck-boost mode. In some cases, the second mode may be a boost mode. In some cases, the driver may further include an electromagnetic interference (EMI) filter operatively connected between the DC power source and the converter and configured to eliminate high frequency components of the DC voltage signal. In some cases, the converter may include a current sensing element including a resistor. In some cases, the converter may include a first inductor and a first diode operatively connected to a second switch that is controlled by a driver controller unit, a current sensing element that senses a current flowing through the first inductor, an output capacitor, and a second inductor that provides an interface between the output capacitor and the load operatively connected to the converter. In some cases, the second threshold voltage may be at least 2.5 volts greater than the first threshold voltage. In some cases, the LED driver may further include the load including an LED string, and an LED string controller that controls a plurality of switches, each switch associated with one or more LEDs in the LED string, in which the LED controller derives the output voltage of the LED driver using the DC voltage signal, current flowing through the a first inductor in the converter, a switching frequency of the first switch, and a duty ratio of the first switch.

Another example embodiment of the present disclosure provides a method for delivering constant current from a DC power source. The method includes converting, using a converter of a driver, a direct current (DC) voltage signal received from a DC power source into a constant current source to provide to a load, controlling, by a controller operatively connected to the converter, a first switch of a mode selection circuit, in which the mode selection circuit includes a diode for returning load current to the DC power source on a first path and the first switch for returning the load current to the DC power source on a second path different from the first path, in response to an output voltage of the driver being less than the DC voltage signal plus a first threshold voltage, turning off the first switch by the controller, thereby enabling a first mode in which the load current is returned to the DC power source on the first path, and in response to the output voltage of the driver being greater than the DC voltage signal plus a second threshold voltage, turning on the first switch by the controller, thereby enabling a second mode in which the load current is returned to the DC power source on the second path.

In some cases, the method may further include eliminating high frequency components from the signal from the DC power source by an electro-magnetic interference (EMI) filter operatively connected between the DC power source and the converter. In some cases, the second threshold voltage may be greater than the first threshold voltage. In some cases, the converter includes a first inductor and a first diode operatively connected to a second switch that is controlled by a driver controller unit, a current sensing element that senses a current flowing through the first inductor, an output capacitor, and a second inductor that provides an interface between the output capacitor and the load operatively connected to the converter. In some cases, the method may further include deriving, by the controller, the output voltage of the driver using the DC voltage signal, a current flowing through the first inductor, a switching frequency of the first switch, and a duty ratio of the first switch.

Another example embodiment of the present disclosure provides a device that includes a controller operatively connected to a converter and a mode selection circuit such that the controller, the converter, and the mode selection circuit provide a driver for a load. The mode selection circuit may include a diode for returning load current to a DC power source on a first path, and a first switch for returning the load current to the DC power source on a second path different from the first path. The controller may be configured with processor-executable instructions to in response to an output voltage of the driver being less than the DC voltage signal plus a first threshold voltage, turn off the first switch thereby enabling a first mode in which the load current is returned to the DC power source on the first path, and in response to the output voltage of the driver being greater than the DC voltage signal plus a second threshold voltage, turn on the first switch thereby enabling a second mode in which the load current is returned to the DC power source on the second path.

In some cases, the second threshold voltage may be greater than the first threshold voltage. In some cases, the device may further include the load including an LED string, and an LED string controller that controls a plurality of switches, each switch associated with one or more LEDs in the LED string, in which the LED controller derives the output voltage of the driver using a DC voltage signal provided by the DC power source, current flowing through the a first inductor in the converter, a switching frequency of the first switch, and a duty ratio of the first switch. In some cases, the converter may include a first inductor and a first diode operatively connected to a second switch that is controlled by a driver controller unit, a current sensing element that senses a current flowing through the first inductor, an output capacitor, and a second inductor that provides an interface between the output capacitor and the load operatively connected to the converter. In some cases, the controller may be further configured with processor-executable instructions to derive the output voltage of the driver using a DC voltage signal provided by the DC power source, a current flowing through the first inductor, a switching frequency of the first switch, and a duty ratio of the first switch. In some cases, the device may further include an electro-magnetic interference (EMI) filter operatively connected between the DC power source and the converter, and configured to eliminate high frequency components of a DC voltage signal from the DC power source.

The foregoing description of the embodiments of the disclosure has been presented for the purposes of illustration and description. It is not intended to be exhaustive or to limit the disclosure to the precise form disclosed. Many modifications and variations are possible in light of this disclosure. It is intended that the scope of the disclosure be limited not by this detailed description, but rather by the claims appended hereto.

What is claimed is:

1. A light emitting diode (LED) driver comprising:

a converter configured to receive a direct current (DC) voltage signal from a DC power source and convert the DC voltage signal into a constant current source to provide to a load;

a mode selection circuit comprising a diode for returning load current to the DC power source on a first path, and a first switch for returning the load current to the DC power source on a second path different from the first path; and a controller, wherein:

in response to an output voltage of the LED driver being less than the DC voltage signal plus a first threshold voltage, the controller is configured to turn off the first switch thereby enabling a first mode in which the load current is returned to the DC power source on the first path; and in response to the output voltage of the LED driver being greater than the DC voltage signal plus a second threshold voltage, the controller is configured turn on the first switch thereby enabling a second mode in which the load current is returned to the DC power source on the second path;

wherein the second threshold voltage is greater than the first threshold voltage.

2. The LED driver of claim 1, wherein the first mode is a buck-boost mode.

3. The LED driver of claim 1, wherein the second mode is a boost mode.

4. The LED driver of claim 1, further comprising an electro-magnetic interference (EMI) filter operatively connected between the DC power source and the converter and configured to eliminate high frequency components of the DC voltage signal.

5. The LED driver of claim 1, wherein the converter comprises a current sensing element including a resistor.

6. The LED driver of claim 1, wherein the converter further comprises:

a first inductor and a first diode operatively connected to a second switch that is controlled by a driver controller unit;

a current sensing element that senses a current flowing through the first inductor;

an output capacitor; and a second inductor that provides an interface between the output capacitor and the load operatively connected to the converter.

7. The LED driver of claim 1, wherein the second threshold voltage is at least 2.5 volts greater than the first threshold voltage.

8. The LED driver of claim 1, further comprising:

the load comprising an LED string; and an LED string controller that controls a plurality of switches, each switch associated with one or more LEDs in the LED string, wherein the LED controller derives the output voltage of the LED driver using the DC voltage signal, current flowing through the a first inductor in the converter, a switching frequency of the first switch, and a duty ratio of the first switch.

9. A method of providing constant current, the method comprising:

converting, using a converter of a driver, a direct current (DC) voltage signal received from a DC power source into a constant current source to provide to a load;

controlling, by a controller operatively connected to the converter, a first switch of a mode selection circuit, wherein the mode selection circuit comprises a diode for returning load current to the DC power source on a first path and the first switch for returning the load current to the DC power source on a second path different from the first path;

in response to an output voltage of the driver being less than the DC voltage signal plus a first threshold voltage, turning off the first switch by the controller, thereby enabling a first mode in which the load current is returned to the DC power source on the first path; and in response to the output voltage of the driver being greater than the DC voltage signal plus a second threshold voltage, turning on the first switch by the controller, thereby enabling a second mode in which the load current is returned to the DC power source on the second path.

10. The method of claim 9, further comprising:

eliminating high frequency components from the signal from the DC power source by an electro-magnetic interference (EMI) filter operatively connected between the DC power source and the converter.

11. The method of claim 9, wherein the second threshold voltage is greater than the first threshold voltage.

12. The method of claim 9, wherein the converter comprises:

a first inductor and a first diode operatively connected to a second switch that is controlled by a driver controller unit;

a current sensing element that senses a current flowing through the first inductor;

an output capacitor; and a second inductor that provides an interface between the output capacitor and the load operatively connected to the converter.

13. The method of claim 12, further comprising:

deriving, by the controller, the output voltage of the driver using the DC voltage signal, a current flowing through the first inductor, a switching frequency of the first switch, and a duty ratio of the first switch.

14. A device comprising:

a controller operatively connected to a converter and a mode selection circuit such that the controller, the converter, and the mode selection circuit provide a driver for a load, wherein:

the mode selection circuit comprises a diode for returning load current to a DC power source on a first path, and a first switch for returning the load current to the DC power source on a second path different from the first path; and the controller is configured with processor-executable instructions to:

in response to an output voltage of the driver being less than the DC voltage signal plus a first threshold voltage, turn off the first switch thereby enabling a first mode in which the load current is returned to the DC power source on the first path; and in response to the output voltage of the driver being greater than the DC voltage signal plus a second threshold voltage, turn on the first switch thereby enabling a second mode in which the load current is returned to the DC power source on the second path.

15. The device of claim 14, wherein the second threshold voltage is greater than the first threshold voltage.

16. The device of claim 14, further comprising:

The load comprising an LED string; and an LED string controller that controls a plurality of switches, each switch associated with one or more LEDs in the LED string, wherein the LED controller derives the output voltage of the driver using a DC voltage signal provided by the DC power source, current flowing through the a first inductor in the converter, a switching frequency of the first switch, and a duty ratio of the first switch.

17. The device of claim 14, wherein the converter comprises:

a first inductor and a first diode operatively connected to a second switch that is controlled by a driver controller unit;

a current sensing element that senses a current flowing through the first inductor;

an output capacitor; and a second inductor that provides an interface between the output capacitor and the load operatively connected to the converter.

18. The device of claim 17, wherein the controller is further configured with processor- executable instructions to:

derive the output voltage of the driver using a DC voltage signal provided by the DC power source, a current flowing through the first inductor, a switching frequency of the first switch, and a duty ratio of the first switch.

19. The device of claim 14, further comprising an electromagnetic interference (EMI) filter operatively connected between the DC power source and the converter, and configured to eliminate high frequency components of a DC voltage signal from the DC power source.

* * * * *